United States Patent [19]

Parasin

[11] Patent Number: 4,807,416

[45] Date of Patent: Feb. 28, 1989

[54] TONGUE AND GROOVE PROFILE

[75] Inventor: Alexander V. Parasin, Vancouver, Canada

[73] Assignee: Council of Forest Industries of British Columbia Plywood Technical Centre, North Vancouver, Canada

[21] Appl. No.: 172,032

[22] Filed: Mar. 23, 1988

[51] Int. Cl.[4] ..... E04F 15/04

[52] U.S. Cl. ..... 52/595; 52/573

[58] Field of Search ..... 52/593, 595, 390, 573, 52/384; 403/364, 345, 282

[56] References Cited

U.S. PATENT DOCUMENTS

| | | | |
|---|---|---|---|
| 444,042 | 1/1891 | Brock | 52/593 |
| 1,460,084 | 6/1923 | Wallis | 52/589 |
| 2,823,433 | 2/1958 | Kendall | 52/589 |
| 2,839,790 | 6/1958 | Collings | 52/589 |
| 3,579,941 | 5/1971 | Tibbals | 52/593 |

FOREIGN PATENT DOCUMENTS

| | | | |
|---|---|---|---|
| 914370 | 11/1972 | Canada . | |
| 2416988 | 7/1979 | France | 52/595 |

*Primary Examiner*—John E. Murtagh

*Attorney, Agent, or Firm*—Townsend and Townsend

[57] ABSTRACT

A tongue and groove plywood panel in which the tongue comprises a protruding lip having a triangular cross-section extending along the length of a first essentially convex edge. The essentially convex edge is formed by sloping surfaces that slope away from the junctions of the tongue and the first edge to the upper and lower veneers of the panel. The groove comprises a triangular cavity formed in a second essentially concave edge opposite the first essentially convex edge. The second essentially concave edge is formed with inwardly sloping surfaces that slope inwardly from the upper and lower veneers of the panel to the groove to form a shallow essentially concave channel along the second edge to guide and direct the tongue into the groove. When the panel is joined to a similar panel, the tongue of one panel engages the groove of the other and the veneers of the joined panels are spaced slightly at the joint due to the sloping surfaces of the first essentially convex edge sloping away from the adjacent sloping surfaces of the second edge of the joined panel. Such an arrangement allows for swelling of the tongue and groove joint of the present invention due to moisture without the buildup of internal stresses which would tend to cause buckling at the joint.

6 Claims, 1 Drawing Sheet

TONGUE AND GROOVE PROFILE

FIELD OF THE INVENTION

This invention relates to a plywood panel having a tongue and groove configuration on their side edges.

BACKGROUND OF THE INVENTION

Tongue and groove plywood panels are used commonly in the construction industry as sub-flooring panels. In the construction of a sub-floor, these panels span the distance between the floor joists of a building with the interlocking tongue and groove side edges of adjacent panels serving to support the panels against deflection between the joists while the end edges of the panels are located over and supported by the joists.

Applicant's Canadian Pat. No. 914,370 discloses a tongue and groove plywood panel of the type mentioned above. Canadian Pat. No. 914,370 discloses a tongue and groove arrangement in which the upper veneers of two adjacent panels are spaced slightly apart at the joint by virtue of a tongue that is slightly longer than the groove is deep. This arrangement allows for swelling of the plywood panel due to moisture. Such swelling often happens as it is common building practice to form the sub-flooring at an early stage in the erection of buildings so that the sub-flooring is exposed to rain and other weather conditions. If the adjacent panels are not spaced along the tongue and groove joint, any swelling of the panel tends to be borne by the butted edges of the joint causing a ridge to form in the top surface of the panel which must be sanded down or otherwise treated to avoid marring the final floor covering.

In applying the final floor covering, the space between the upper surfaces of adjacent panels is filled in by a filling agent or by the adhesive used in the application of the final covering in order to form a smooth base.

SUMMARY OF THE INVENTION

The present invention offers an improved tongue and groove plywood panel to that disclosed in Canadian Pat. No. 914,370. The present invention comprises a tongue and groove panel in which the tongue comprises a protruding lip having a triangular cross-section extending along the length of a first essentially convex edge said first essentially convex edge being formed by sloping surfaces that slope away from the junctions of said tongue and said first edge to the upper and lower veneers of the panel, and the groove comprises a triangular cavity formed in a second essentially concave edge opposite said first essentially convex edge, said second essentially concave edge being formed with inwardly sloping surfaces that slope inwardly from the upper and lower veneers of the panel to the groove to form a shallow essentially concave channel along said second edge to guide and direct said tongue into said groove, the tongue having a tip and the groove having a base, so that when the panel is joined to a similar panel, the tip of the tongue of one panel will engage the base of the groove of the other, and the veneers of the joined panels will be spaced slightly at the joint due to the sloping surfaces of said first essentially convex edge sloping away from the adjacent sloping surfaces of said second essentially concave edge of the joined panel.

Using the tongue and groove profile of the present invention, it has been found that mating the abutted edges of the panel is easier as compared to existing tongue and groove joints as the triangular tongue tends to centre in the triangular groove.

In addition, the present tongue and groove panels provide a high strength joint having a large load transfer capacity.

BRIEF DESCRIPTION OF THE DRAWINGS

The present invention is illustrated in the accompanying drawings in which.

DESCRIPTION OF THE PREFERRED EMBODIMENTS

Figure 1:
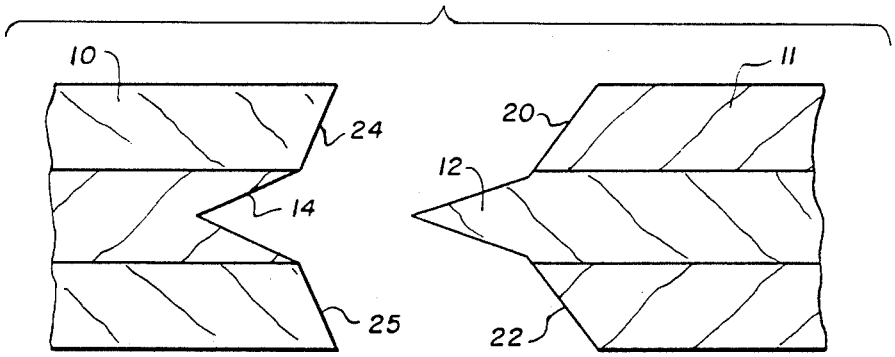
FIG. 1 shows the tongue and groove edges of a first embodiment of the present invention immediately prior to assembly.

Referring to FIG. 1, there are shown two panels 10 and 11 which are similar in all respects, each having a tongue 12 along one side edge and a groove 14 formed in the opposite side edge. Tongue 12 has a triangular cross-section and is formed in a preferred embodiment within a single veneer layer of the plywood panel. Above and below tongue 12, angled faces 20 and 22 slope away from tongue 12 to meet with the upper and lower surfaces of the panel giving the edge of the panel an essentially convex shape.

Groove 14 comprises a triangular cavity separating inwardly sloping faces 24 and 25 and cut along the side edge of the panel opposite the tongue edge. Like the tongue 12, groove 14 is preferably formed within a single veneer layer of the panel. The location of the groove is fixed by indexing from the upper surface of the panel as is the location of the tongue so that when a joint is made between two panels the upper surfaces of the panels will be substantially co-planar. To avoid the possibility of mis-assembly, it is convenient to identify the surfaces of the panels as top and bottom.

Figure 2:
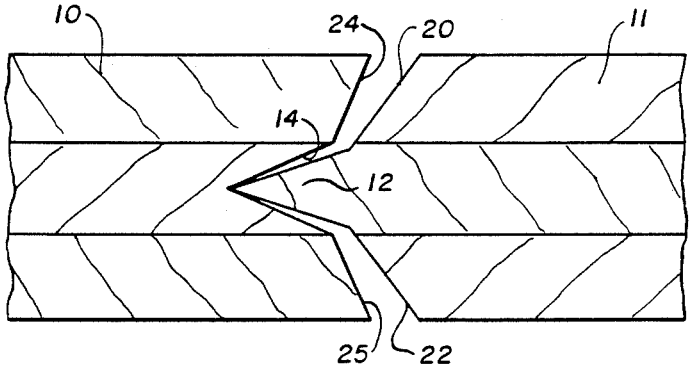
FIG. 2 shows the panels of FIG. 1 after assembly.

The panels of FIG. 1 are shown joined in FIG. 2. Tongue 12 being longer than groove 14 is deep and sloping surfaces 20 and 22 sloping away from sloping faces 24 and 25 of the grooved edge combine to create a gap between the upper veneers of the panels which allows for swelling of the panels after joining. As well, the angle included between the surfaces of tongue 12 is less than the angle included between the faces of groove 14 so that free space is left between the tongue and the groove to allow for expansion of the tongue.

By sloping surfaces 24 and 25 of the grooved edge, the resulting concave edge serves to guide and direct tongue 12 into groove 14.

Figure 3:
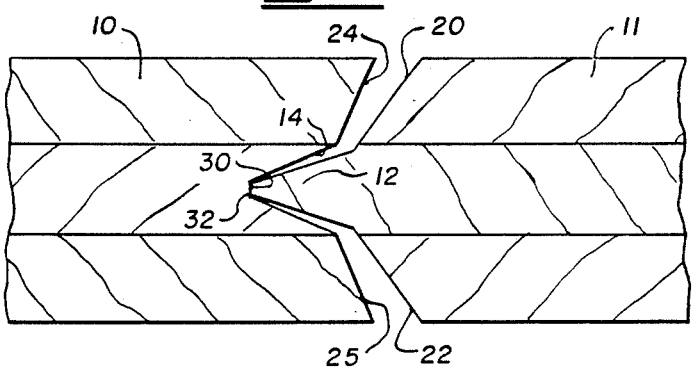
FIG. 3 shows a second embodiment of the present invention using a blunted tongue and groove configuration.

FIG. 3 shows a second embodiment of the present invention in which the base of groove 14 and the tip of tongue 12 are formed into flat surfaces 30 and 32 respectively.

The tongue and groove panels of the present invention provide a joint that is resistant to internal stresses that build up due to moisture induced swelling. The gap between adjoining panels and the clearance provided between a tongue 12 inserted in a groove 14 allow for swelling of the wood in the joint due to moisture without the resulting internal stresses that would otherwise cause buckling of the joint.

The tongue and groove panels of the present invention provides a high strength joint. When panels joined according to the present invention are loaded, forces are transferred from panel to panel along the tip of the tongue housed in the bottom of a groove where the bending moment applied to the groove is at a minimum. As the load increases, the tongue 12 will tend to bend slightly transferring the load across a sloped face of groove 14. Due to the triangular cross section of tongue 12 gradually increasing in thickness, the section modulus of the tongue cross section also increases as the arm of the moment applied to the tongue increases. This arrangement provides for a gradual and optimum transfer of forces in the joint and results in a high load transfer capacity.

It is understood that the panels of the present invention can be constructed of any thickness and any number of plies. In the case of plywood panels having more than three plies, tongue 12 and groove 14 may extend into multiple veneer layers of plywood.

I claim:

1. A tongue and groove plywood planel comprising in which the tongue comprises a protruding lip having a triangular cross-section extending along the length of a first essentially convex edge, said first essentially convex edge being formed by sloping surfaces that slope away from the junctions of said tongue and said first edge to the upper and lower veneers of the panel, and the groove comprises a triangular cavity formed in a second essentially concave edge opposite said first essentially convex edge, said second essentially concave edge being formed with inwardly sloping surfaces that slope inwardly from the upper and lower veneers of the panel to the groove to form a shallow essentially concave channel along said second edge to guide and direct said tongue into said groove, the tongue having a tip and the groove having a base, so that when the panel is joined to a similar panel, the tip of the tongue of one panel will engage the base of the groove of the other, and the veneers of the joined panels will be spaced slightly at the joint due to the sloping surfaces of said first essentially convex edge sloping away from the adjacent sloping surfaces of said second essentially concave edge of the joined panel.

2. A tongue and groove panel as claimed in claim 1 in which the angle included between the surfaces of said triangular tongue is less than the angle included between the faces of said triangular groove.

3. A tongue and groove panel as claimed in claim 1 in which said tongue and groove are formed in a single veneer layer of the plywood sheet and do not extend into adjacent layers.

4. A tongue and groove panel as claimed in claim 1 in which said tongue is longer than said groove is deep.

5. A tongue and groove panel as claimed in claim 1 in which said tip of the tongue is flat and lies in a plane substantially normal to the plane of the veneers.

6. A tongue and groove panel as claimed in claim 1 in which said base of the groove is flat and lies in a plane substantially normal to the plane of the veneers.

* * * * *